US007991176B2

(12) United States Patent
Kirkeby

(10) Patent No.: US 7,991,176 B2
(45) Date of Patent: Aug. 2, 2011

(54) STEREO WIDENING NETWORK FOR TWO LOUDSPEAKERS

(75) Inventor: Ole Kirkeby, Espoo (FI)

(73) Assignee: Nokia Corporation, Espoo (FI)

( * ) Notice: Subject to any disclaimer, the term of this patent is extended or adjusted under 35 U.S.C. 154(b) by 1229 days.

(21) Appl. No.: 10/999,842

(22) Filed: Nov. 29, 2004

(65) Prior Publication Data

US 2006/0115090 A1 Jun. 1, 2006

(51) Int. Cl.

| | |
|---|---|
| ***H04R 1/02*** | (2006.01) |
| ***H04R 9/06*** | (2006.01) |
| ***H04R 5/00*** | (2006.01) |
| ***H04R 5/02*** | (2006.01) |

(52) U.S. Cl. ..... 381/334; 381/17; 381/300

(58) Field of Classification Search ..... 381/17, 381/18, 1, 19–23, 334, 300, 61, 119
See application file for complete search history.

(56) References Cited

U.S. PATENT DOCUMENTS

| | | | | |
|---|---|---|---|---|
| 3,236,949 | A | 2/1966 | Atal et al. | |
| 4,049,912 | A | 9/1977 | Mitchell | |
| 4,191,852 | A | 3/1980 | Nishikawa | |
| 5,136,650 | A | 8/1992 | Griesinger | |
| 5,136,651 | A | 8/1992 | Cooper et al. | |
| 5,384,851 | A * | 1/1995 | Fujimori | 381/17 |
| 5,687,239 | A * | 11/1997 | Inanaga et al. | 381/309 |
| 5,949,894 | A | 9/1999 | Nelson et al. | |
| 6,307,941 | B1 | 10/2001 | Tanner, Jr. | |
| 6,614,910 | B1 * | 9/2003 | Clemow et al. | 381/1 |
| 6,760,447 | B1 | 7/2004 | Nelson et al. | |
| 7,454,026 | B2 * | 11/2008 | Yamada | 381/310 |
| 2005/0131562 | A1 | 6/2005 | Kang et al. | |
| 2005/0135629 | A1 | 6/2005 | Kim et al. | |

FOREIGN PATENT DOCUMENTS

| | | |
|---|---|---|
| EP | 0880871 | 12/1998 |
| EP | 1194007 | 4/2002 |
| EP | 1355509 | 10/2003 |
| JP | 5041900 | 2/1993 |
| WO | WO 95/15069 | 6/1995 |
| WO | WO 98/36615 | 8/1998 |

* cited by examiner

*Primary Examiner* — Vivian Chin
*Assistant Examiner* — Douglas J Suthers
(74) *Attorney, Agent, or Firm* — Alfred A. Fressola; Ware, Fressola, Van Ser Sluys & Adolphson LLP

(57) ABSTRACT

The invention relates to a method, a system, a module, an electronic device and to a computer program product for widening a two-channel input. Two audio channels are input and filtered by equalizing said channels. The filtered channels are mixed with their opposite channels in a cross-talk network and output from loudspeakers and by this providing a spatial impression for audio.

27 Claims, 3 Drawing Sheets

STEREO WIDENING NETWORK FOR TWO LOUDSPEAKERS

FIELD OF THE INVENTION

This invention relates generally to audio processing and particularly to such an audio processing, where two-channel input is widened when using two loudspeakers.

BACKGROUND OF THE INVENTION

Spatial sound is possible to create by a surround system that comprises different loudspeakers for different audio channels. In a standard setup of a stereo system of two loudspeakers, said loudspeakers span 60 degrees. For giving the impression that sound sources move around inside the area between the two loudspeakers, amplitude panning can be used. Such sound sources, whose positions correspond to positions away from the loudspeakers are usually referred to as "virtual sources" or "phantom images". In other words, a virtual sound source is localized by the listener, but is not produced by a loudspeaker at the location.

Patent publication U.S. Pat. No. 3,236,949 presents a cross-talk cancellation network, which was the first description of how to make the sound appear to come from outside the angle spanned by the loudspeakers. Said publication assumes widely spaced loudspeakers and free-field sound propagation, which means it does not take into account the influence of the listeners head on the incident sound waves. Because of its assumption the implementation with analogue electronics is straightforward.

Influence of the listeners head is introduced in patent publication U.S. Pat. No. 5,136,651. This publication describes how this effect can be included in virtual systems. The design of a cross-talk cancellation system then becomes significantly more complicated than in the free-field case and a "shuffler" is introduced, which is an efficient way to implement a 2-by-2 filter matrix.

The problem with sensitivity to head movement when using two widely spaced loudspeakers is considered in patent publication WO 95/15069. In this publication, the gain of the off-diagonal elements of the symmetric 2-by-2 filter matrix is reduced, thereby increasing the size of the sweet spot at the expense of a modest decrease in performance. It is assumed that the source material is binaural, which means it is prepared for playback over headphones.

Also, patent publication EP0880871B1 describes various ways to use two closely spaced loudspeakers for spatial enhancement. There is some discussion of how to avoid the low-frequency boost in the cross-talk cancellation network and in the loudspeaker inputs for virtual images well outside the angle spanned by the loudspeakers. It is not considered how to adjust the strength of the spatial effect or how to constrain the processed sound relative to the unprocessed sound. The emphasis is mainly on the design and properties of the digital filters necessary for implementing virtual sources at specific positions in high-fidelity applications.

It is easily appreciated that when two loudspeakers are close together, the area between them is not wide enough for the spatial effect resulting from moving the sources around inside the area. In this case it is necessary to create the impression that the sound is coming from outside the angle spanned by the two loudspeakers. The principle for achieving this is based on processing the inputs to the two loudspeakers so that the sound reproduced at the ears of the listener to some extent approximates the sound that would have been produced there by a real sound source. It is well known that a result of this principle is that a powerful out-of-phase low-frequency output is required in order to create a virtual source well outside the angle spanned by the loudspeakers. There is a good reason to consider ways to limit the input to the loudspeaker, especially with portable devices.

The centre of a sound stage is often the most important part. However, not much attention has been paid to it in the context of spatial enhancement systems. In stereo music tracks, e.g. the vocals are usually in the centre. Similarly in films, the speech is targeted to the centre. It is advantageous that this part is not coloured spectrally by the spatial processing. In addition to preserving the sound quality, the faithful reproduction of the centre of the sound stage guarantees a reasonably loud acoustical output from the small loudspeakers in portable devices.

It can be seen, that the solutions of related art may not fulfill the requirements of all the current electronic devices. Devices that comprise two loudspeakers very close to each other (e.g. on both sides of a display) can be used as example. With these devices the direction of sound may have a significant role. The present invention is considered for use mainly when the virtual sources are essentially static. Thus, examples of applications are enhancement of music and video in either the two channel stereo format or the 5.1 multi-channel format, and teleconferencing in which the voices of the participants are allocated to a relatively small number of positions. However the invention can also be used as a post-processing module for other types of audio material in which the virtual sources are not necessarily static.

SUMMARY OF THE INVENTION

Therefore, in an improved method for widening spatial output of loudspeakers a first and a second audio channels are received and equalized, said first equalized channel is mixed with a second equalized channel that has been delayed, scaled down and inverted and said second equalized channel is mixed with a first equalized channel that has been delayed, scaled down and inverted, whereby the mixed first and second channels are output.

A system according to one embodiment for widening output of loudspeakers comprises at least input means for receiving a first and a second audio channels, a filter for equalizing said first and second audio channels, means for mixing said first equalized channel with said second equalized channel that has been delayed, scaled down and inverted, and mixing said second equalized channel with said first equalized channel that has been delayed, scaled down and inverted, and output means for outputting the mixed first and second audio channels.

A module according to one embodiment for widening output of audio comprises input means for receiving a first and a second audio channels, an equalizer for equalizing said first and second audio channels, means for mixing said first equalized channel with said second equalized channel that has been delayed, scaled down and inverted, and mixing said second equalized channel with said first equalized channel that has been delayed, scaled down and inverted, and output means for outputting the mixed first and second audio channels.

An electronic device according to one embodiment with two loudspeakers, comprising means for widening output of said loudspeakers, said means including at least input means for receiving a first and a second audio channels, an equalizer for equalizing said first and second audio channels, means for mixing said first equalized channel with said second equalized channel that has been delayed, scaled down and inverted, and mixing said second equalized channel with said first equalized channel that has been delayed, scaled down and inverted, and output means for outputting the mixed first and second audio channels.

A computer program product according to one embodiment for widening spatial output of loudspeakers comprises computer readable instructions for receiving at least a first and a second audio channels and equalizing said audio channels, mixing said first equalized channel with the second filtered channel that has been delayed, scaled down and inverted, and mixing said second equalized channel with the first filtered channel that has been delayed, scaled down and inverted, outputting the mixed first and second audio channels.

Other embodiments are described in appended dependent claims.

This invention describes a digital signal processing algorithm that can extend the sound stage beyond the angle spanned by two loudspeakers. Since the strength of the spatial effect is adjustable, any compromise between spatial effect, loudness and sound quality under the constraint of the limited acoustic output available from the two small loudspeakers can be achieved.

The stereo widening network is used to give a listener the impression that the sound comes from positions outside the angle spanned by two loudspeakers. Therefore the invention improves enormously the output of two closely spaced loudspeakers, such as those locating on different sides (left, right, above, below) of the screen, as in mobile phones or another type of portable devices. The loudspeakers can naturally be a separate component that can be attached in a known manner to an electronic device.

According to the solution the sound quality is optimal at the centre of the sound stage. This improves the solutions of related art enormously, because previously the centre has received no attention. In addition, the spatial effect is adjustable on a continuous scale.

Further, even when small loudspeakers are used, reasonably loud acoustic output is guaranteed, thanks to the subject-matter.

With an optional pre-processing module there is an alternative way to adjust the strength of the spatial effect, hence providing advantage to the sound quality.

The solution according to the invention is computationally extremely efficient, which has a great benefit not only with portable devices but also with other electronic devices.

DESCRIPTION OF THE DRAWINGS

A better understanding of the subject-matter may be obtained from the following considerations taken in conjunction with the accompanying drawings.

DETAILED DESCRIPTION OF THE INVENTION

Figure 1:
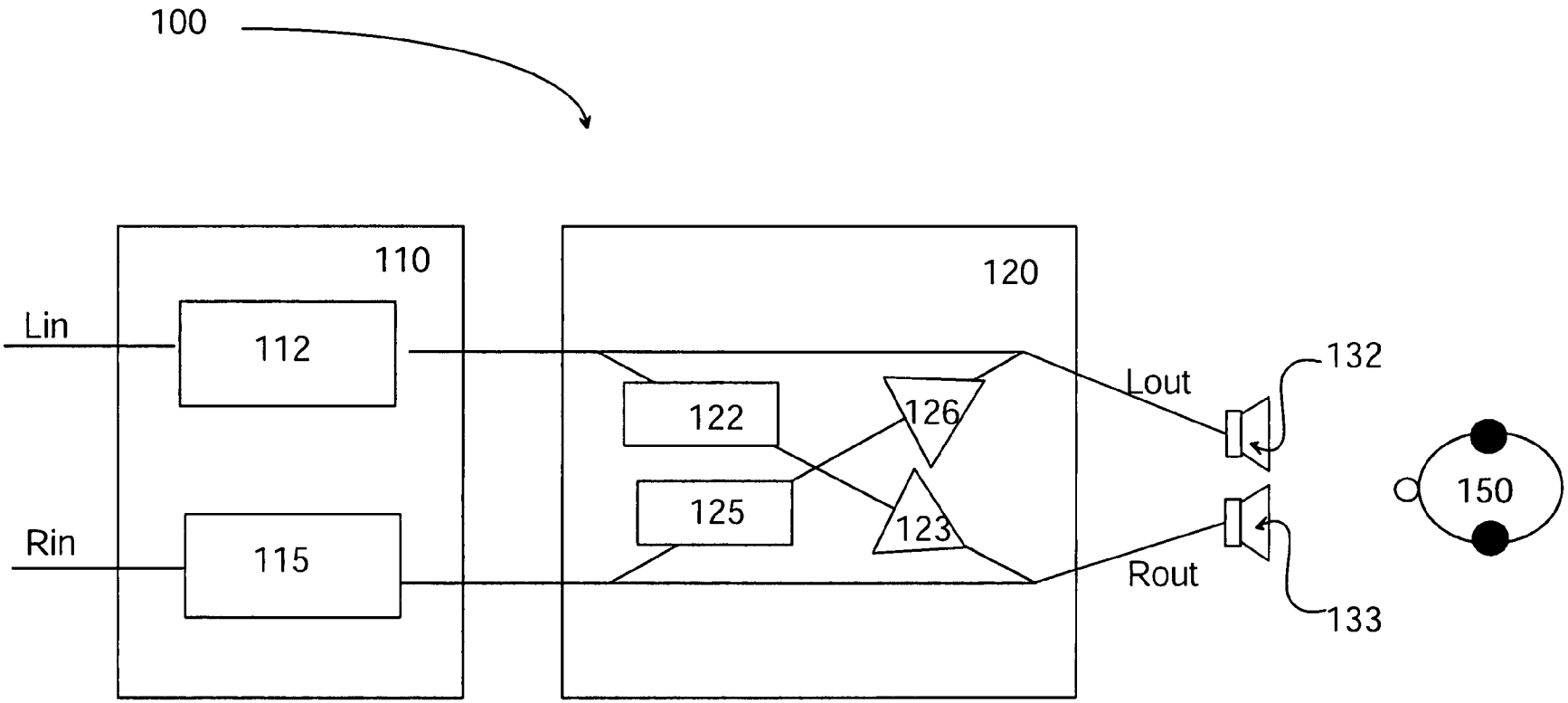
FIG. 1 illustrates an example of the stereo widening network according to one embodiment.

Although specific terms are used in the following description for the sake of clarity, these terms are intended to refer only to the particular structure of the subject-matter selected for illustration in the drawings and are not intended to define or limit the scope of the invention.

FIG. 1 illustrates a possible configuration of a stereo widening network 100. In this example the network comprises left ($L_{in}$) and right ($R_{in}$) inputs and corresponding outputs ($L_{out}$, $R_{out}$). Two audio channels are taken in and processed in the network 100. The two main parts of the stereo widening network 100 are an equalizer 110 and a cross-talk network 120. The function of the equalizer 110 is to filter each of the audio channels ($L_{in}$, $R_{in}$), e.g. by two IIR comb filters (Infinite Impulse Response) 112, 115. The function may be similar for each of the channels ($L_{in}$, $R_{in}$):

$$EQ(z) = \frac{1}{1 - gz^{-N}},$$

The function of the cross-talk network 120 is to mix the direct channel (from the equalizer) with the opposite channel. The opposite channel in the mixing procedure is delayed by N samples (122, 125) and scaled down by gain g (126, 123). The cross-talk network H(z) (120) is:

$$H(z) = \begin{bmatrix} 1 & -gz^{-N} \\ -gz^{-N} & 1 \end{bmatrix}.$$

The cross-talk network 120 does not need to include any filtering operations apart from simple scaling and delaying. The frequency dependent filtering operation is isolated to equalizer 110, whereby the equalizing is common for both channels. The value of the gain g is between 0 and 1, and it determines the strength of the spatial effect. When the gain is 0 the cross-talk network 120 acts as a bypass, whereas when the gain is close to 1, there is a large amount of cross-talk and a powerful low-frequency boost from the equalizer. In practice, the values for the gain for producing a desirable spatial effect are typically in the range between 0.3 and 0.8. The value of N depends on the angle spanned by the loudspeakers 132, 133. In practice N is of the order of a few samples for a sampling frequency of 48kHz. For a loudspeaker spacing of 5 cm, N=1 works well, when the distance to the listener's 150 head is about 40 cm. For a loudspeaker spacing of 10 cm, N=2 works well. For low sampling frequencies and very narrow loudspeaker spans a fractional delay can be used since the optimal delay is less than one sample. In addition, a fractional delay is also useful for tuning the delay accurately in a specific use case. For example, a Lagrange FIR filter (Finite Impulse Response) with three coefficients can be used to vary the fractional delay continuously from 0 to 2 samples while still allowing a simple implementation of the equalizer EQ(z).

The stereo widening network shown in FIG. 1 implements a 2-by-2 matrix multiplication of the type $$\begin{bmatrix} L_{out} \\ R_{out} \end{bmatrix} = EQ(z)H(z)\begin{bmatrix} L_{in} \\ R_{in} \end{bmatrix}.$$

It can be easily verified that if the two inputs are the same ($L_{in}$=$R_{in}$) then the outputs are the same as the inputs ($L_{out}$=$R_{out}$=$L_{in}$=$R_{in}$) regardless of the value of the gain g. This property guarantees that the centre of the sound stage is always faithfully reproduced.

The stereo widening network 100 is formed by at first formulating the matrix C(z):

$$C(z) = \begin{bmatrix} 1 & gz^{-N} \\ gz^{-N} & 1 \end{bmatrix},$$

which is the digital version of the free-field transfer function matrix of the publication U.S. Pat. No. 3,236,949. The inverse of C(z) is given by:

$$C^{-1}(z) = \frac{1}{1 - g^2 z^{-2N}} \begin{bmatrix} 1 & -gz^{-N} \\ -gz^{-N} & 1 \end{bmatrix}.$$

The transfer matrix of the stereo widening network 100 shown in FIG. 1 can be written in terms of the inverse of C(z), $$EQ(z)H(z)=(1+gz^{-N})C^{-1}(z),$$

which shows that according to one embodiment there is a cross-talk canceller in series with a filter. Even though the cross-talk canceller is in some aspects similar to the one described in the publication U.S. Pat. No. 3,236,949, the subject-matter itself differs greatly from it. The cross-talk network 120 according to one embodiment is intended for use with closely spaced loudspeakers, not widely spaced. The cross-talk network 120 is intended for use mainly with stereo signals that contain level differences, as is typically the case with music on audio CDs, rather than time differences, as is typically the case with binaural signals. The gain is used to adjust the strength of the spatial effect and not determined on physical grounds through the transfer matrix. The cross-talk network 120 according to one embodiment includes a constraint to ensure that it acts as a bypass when the two inputs are identical.

Figure 2:
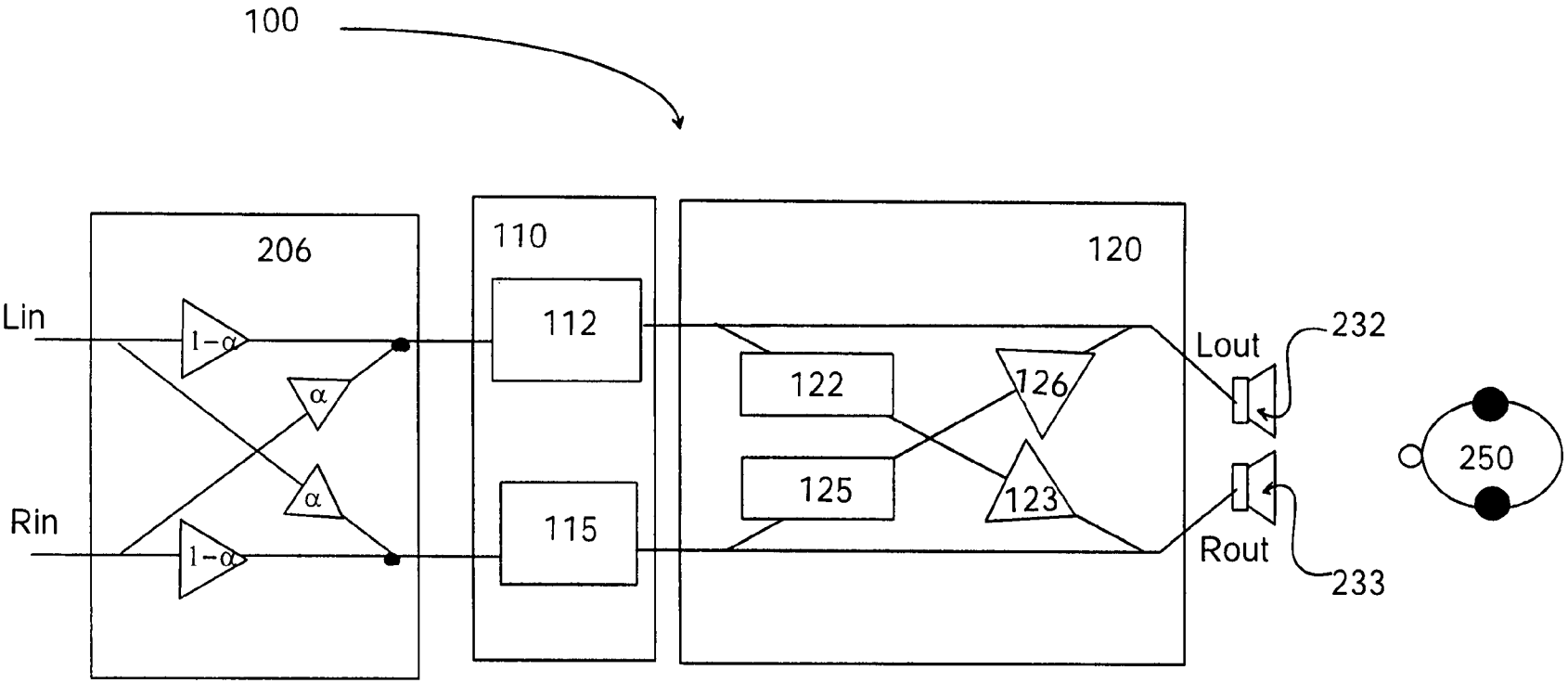
FIG. 2 illustrates another example of the stereo widening network according to one embodiment.

Another example of the subject-matter is illustrated in FIG. 2. An optional pre-processing module P (206), which is a mixer that implements basic amplitude panning, can be used as a sound stage 'width controller'. As an example, the case where the source material is a two-channel stereo music ($L_{in}$, $R_{in}$) is presented. The pre-processing module 206 is formed by formulating the amplitude panning matrix P:

$$P = \begin{bmatrix} 1-\alpha & \alpha \\ \alpha & 1-\alpha \end{bmatrix}$$

where $0<\alpha<0.5$, as by example. It can be verified that when the two inputs are identical the pre-processing module 206 acts as a bypass just as the cascade of EQ(z) and H(z). Thus, the centre of the sound stage is preserved for any value of mixing parameter $\alpha$. When mixing parameter $\alpha$ is increased from 0 to 0.5, pre-processing module 206 narrows the sound stage gradually from full stereo width to a single point in the centre. Consequently, pre-processing module 206 provides another way to adjust the strength of the spatial effect. In practice, it is sometimes advantageous to use a value of $\alpha$ just above zero for the maximum stereo widening effect. In teleconferencing applications different values of mixing parameter $\alpha$ can be used to position the participants across the sound stage. The amplitude panning technique is known as such and has been used in the production of music mixed for playback over two widely spaced loudspeakers. However, with the stereo widening network according to the invention, it provides an alternative way to adjust the strength of the spatial effect.

Figure 3B:
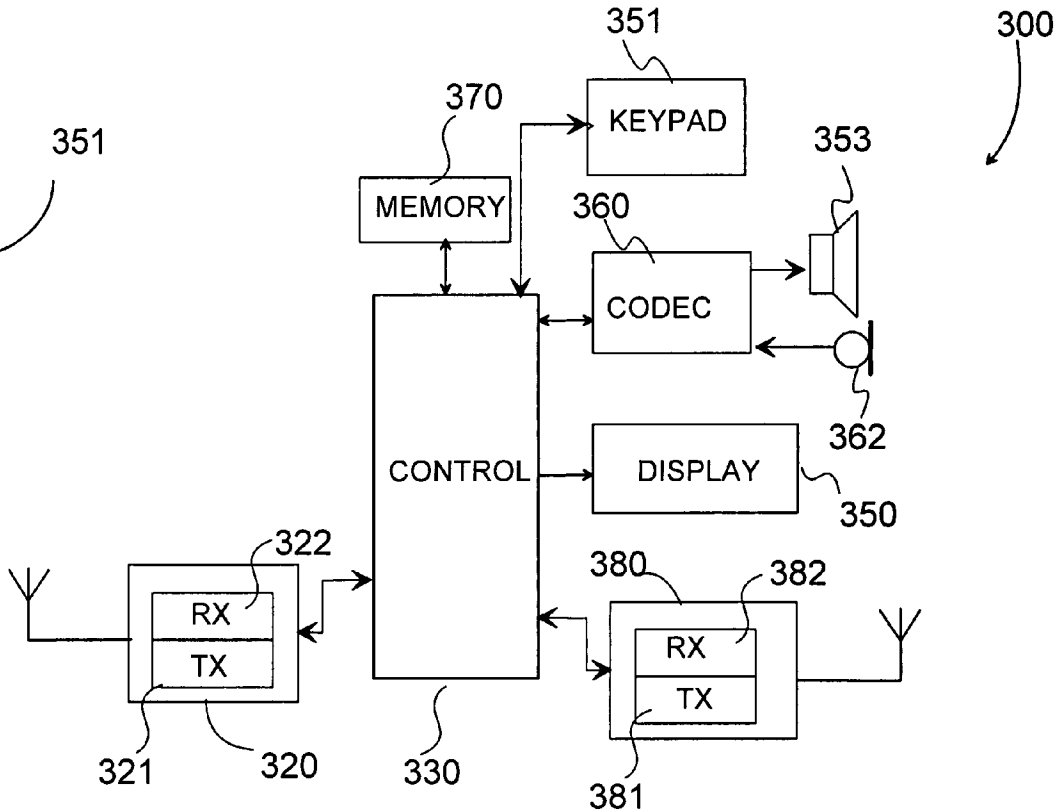
FIG. 3*b* illustrates a block chart example of the device according to one embodiment.
Figure 3A:
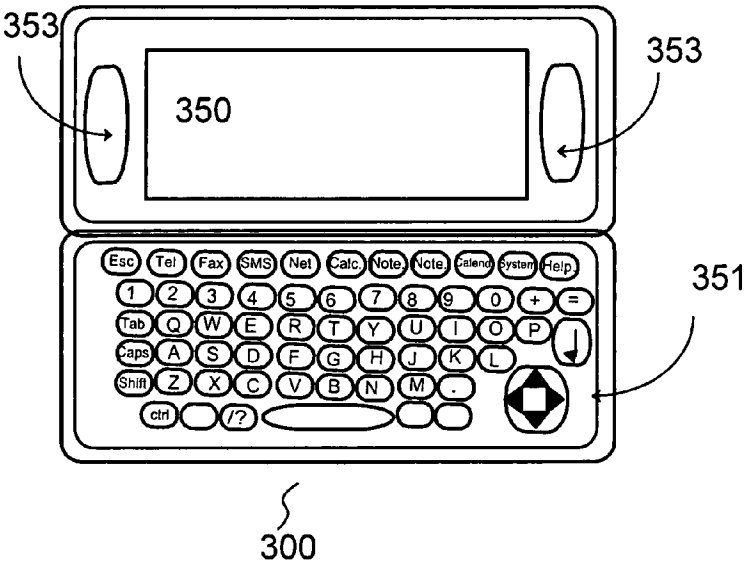
FIG. 3*a* illustrates an example of the device according to one embodiment.

The stereo widening network 100 can be arranged into a device that is capable of audio outputting. As an example, a device having two loudspeakers close to each other is mentioned. This kind of device can be a mobile terminal, a PDA-device, a wired or wireless computer, communicator, a hand-held gaming device etc. The stereo widening network can be a part of digital audio signal processing to be installed as a module into said device. One example of the device is illustrated in a very simplified manner in FIGS. 3*a*, 3*b*. The device 300 can comprise a communication means 320 having a transmitter 321 and a receiver 322. There can be also other communicating means 380 having a transmitter 381 and a receiver 382. The first communicating means 320 can be adapted for telecommunication and the other communicating means 380 can be a one kind of short-range communicating means, such as Bluetooth™ system, WLAN system (Wireless Local Area Network) or other system which is suited for local use and for communicating with another device. The device 300 according to this example comprises also a display 350 for displaying visual information. In addition the device 300 comprises a keypad 351 for inputting data, for controlling audio setting, for gaming etc. The device 300 comprises audio means 360, such as an earphone 353 and a microphone 362 and optionally a codec for coding (and decoding, if needed) the audio data. The device 300 comprises also a control unit 330 for controlling functions in the device 300. The control unit 330 may comprise one or more processors (CPU, DSP). The device further may comprise memory 370 for storing data, programs etc.

The solution disclosed in this description is mainly for spatial enhancement of music and video as well as for teleconferencing.

One skilled in the art will appreciate that the stereo widening system may incorporate any number of capabilities and functionalities, which are suitable for enhancing the efficiency. It will be clear that variations and modifications of the example of embodiment described are possible without departing from the scope of protection of the subject-matter as set forth in the claims.

What is claimed is:

1. A method comprising:

receiving a first audio channel and a second audio channel, sampling said first audio channel and said second audio channel at a sampling frequency, equalizing the sampled first audio channel and the sampled second audio channel to form a first equalized channel and a second equalized channel, mixing said first equalized channel with the second equalized channel after the second equalized channel has been delayed, scaled down and inverted, mixing said second equalized channel with the first equalized channel after the first equalized channel has been delayed, scaled down and inverted, by a control unit of a portable device, outputting the mixed first and second channels so as to widen spatial output of at least two closely spaced loudspeakers of said portable device, wherein the widened spatial output creates a spatial effect so that sound generated by said closely spaced loudspeakers has the impression of coming from outside an angle spanned by said loudspeakers, and using a fractional delay of less than one sample of the first and second equalized channels for tuning the delay.

2. The method according to claim 1, further comprising scaling down the first and the second channels with a gain having a value between 0 and 1.

3. The method according to claim 1, further comprising scaling down the first and the second channels with a gain having a value between 0.3 and 0.8.

4. The method according to claim 1, wherein equalizing is carried out by infinite impulse response filters.

5. The method according to claim 1, further comprising using a finite impulse response filter for varying the fractional delay.

6. The method according to claim 1, wherein outputting the mixed first and second channels uses:

$$EQ(z)H(z) = (1+gz^{-N})C^{-1}(z),$$

wherein $$C^{-1}(z) = \frac{1}{1-g^2z^{-2N}}\begin{bmatrix} 1 & -gz^{-N} \\ -gz^{-N} & 1 \end{bmatrix},$$

where EQ(z) is an equalizer function, H(z) is a cross-talk network, g is gain, and N is the number of samples of said delay.

7. The method according to claim 1, further comprising adjusting the spatial output by amplitude panning matrix P:

$$P = \begin{bmatrix} 1-\alpha & \alpha \\ \alpha & 1-\alpha \end{bmatrix}$$

where $\alpha$ is a mixing parameter.

8. The method according to claim 7, further comprising narrowing the spatial output by increasing a value of $\alpha$ from 0 to 0.5.

9. The method according to claim 7, further comprising maintaining $\alpha$ just above zero for maximum stereo widening effect.

10. An apparatus comprising:

an input configured to receive a first audio channel and a second audio channel and to sample said first audio channel and said second audio channel at a sampling frequency, a filter configured to equalize said sampled first audio channel and said sampled second audio channel to form a first equalized channel and a second equalized channel, a cross-talk network configured to mix said first equalized channel with the second equalized channel after the second equalized channel has been delayed, scaled down and inverted, and to mix said second equalized channel with the first equalized channel after the first equalized channel has been delayed, scaled down and inverted, an output physically configured to output the mixed first and second audio channels so as to provide a widened spatial output to at least two closely spaced loudspeakers, wherein the widened spatial output creates a spatial effect so that sound generated by said closely spaced loudspeakers has the impression of coming from outside an angle spanned by said loudspeakers of a portable device, and another filter configured to vary a fractional delay of less than one sample of the first and second equalized channels for tuning the delay.

11. The apparatus according to the claim 10, comprising a delay for each of the audio channels.

12. The apparatus according to the claim 10, wherein said filter is a infinite impulse response filter.

13. The apparatus according to claim 10, comprising means for delivering the output to the loudspeakers.

14. The apparatus according to claim 10, comprising a processor configured to amplitude pan.

15. The apparatus of claim 10, wherein the another filter is a finite impulse response filter.

16. A module comprising:

an input configured to receive a first audio channel and a second audio channel and to sample said first audio channel and said second audio channel at a sampling frequency, an equalizer configured to equalize said sampled first audio channel and said sampled second audio channel to form a first equalized channel and a second equalized channel, a cross-talk network configured to mix said first equalized channel with the second equalized channel after the second equalized channel has been delayed, scaled down and inverted, and to mix said second equalized channel with the first equalized channel after the first equalized channel has been delayed, scaled down and inverted, an output physically configured to output the mixed first and second audio channels so as to provide a widened spatial output to at least two closely spaced loudspeakers of a portable device, wherein the widened spatial output creates a spatial effect so that sound generated by said closely spaced loudspeakers has the impression of coming from outside an angle spanned by said loudspeakers, and a filter configured to vary a fractional delay of less than one sample of the first and second equalized channels for tuning the delay.

17. The module according to claim 16 comprising a delay for each of the audio channels.

18. The module according to the claim 16, wherein said equalizer is a infinite impulse response filter.

19. The module according to claim 16 further comprising a processor configured to amplitude pan.

20. The module of claim 16, wherein the filter is a finite impulse response filter.

21. A portable device comprising:

at least two closely spaced loudspeakers, an input configured to receive a first audio channel and a second audio channel and to sample said first audio channel and said second audio channel at a sampling frequency, an equalizer configured to equalize said sampled first audio channel and said sampled second audio channel to form a first equalized channel and a second equalized channel, a cross-talk network configured to mix said first equalized channel with the second equalized channel after the second equalized channel has been delayed, scaled down and inverted, and to mix said second equalized channel with the first equalized channel after the first equalized channel has been delayed, scaled down and inverted, and an output configured to output the mixed first and second audio channels so as to provide a widened spatial output to the closely spaced loudspeakers, wherein the widened spatial output creates a spatial effect so that sound generated by said closely spaced loudspeakers has the impression of coming from outside an angle spanned by said loudspeakers, and a filter configured to vary a fractional delay of less than one sample of the first and second equalized channels for tuning the delay.

22. The device according to claim 21, comprising a delay for each of the audio channels.

23. The device according to the claim 21, wherein said equalizer is a infinite impulse response filter.

24. The module according to claim 21, further comprising a processor configured to amplitude pan.

25. The device of claim 21, wherein the filter is a finite impulse response filter.

26. An apparatus comprising a processor, and a non-transitory computer-readable storage medium encoded with instructions, the computer-readable storage medium and the instructions configured to, with the processor, cause the apparatus at least to perform receiving at least a first audio channel and a second audio channel sampling said first audio channel and said second audio channel at a sampling frequency, equalizing the sampled first audio channel and the sampled second audio channel to form a first equalized channel and a second equalized channel, mixing said first equalized channel with the second equalized channel after the second equalized channel has been delayed, scaled down and inverted, and mixing said second equalized channel with the first equalized channel after the first equalized channel has been delayed, scaled down and inverted, outputting the mixed first and second audio channels so as to widen a spatial output of at least two closely spaced loudspeakers, wherein the widened spatial output creates a spatial effect so that sound generated by said closely spaced loudspeakers has the impression of coming from outside an angle spanned by said loudspeakers of a portable device, and using a fractional delay of less than one sample of the first and second equalized channels for tuning the delay.

27. The apparatus according to claim 26, further comprising instructions for adjusting the spatial output by amplitude panning.

* * * * *